US008770828B2

(12) United States Patent
Ching et al.

(10) Patent No.: US 8,770,828 B2
(45) Date of Patent: Jul. 8, 2014

(54) OSCILLATOR SYSTEM

(75) Inventors: Ho Ching, Kowloon (HK); Ching Tom Kong, New Territories (HK); Guang Li Ma, Tianjin (CN)

(73) Assignees: MicroTechne Research & Development Center Ltd., Hong Kong (HK); Tianjin Sea-gull Watch Co. Ltd., Tianjin (CN)

( * ) Notice: Subject to any disclaimer, the term of this patent is extended or adjusted under 35 U.S.C. 154(b) by 125 days.

(21) Appl. No.: 13/045,163

(22) Filed: Mar. 10, 2011

(65) Prior Publication Data

US 2011/0222377 A1 Sep. 15, 2011

(30) Foreign Application Priority Data

Mar. 12, 2010 (HK) ..... 10102613.1

(51) Int. Cl.
*G04B 17/06* (2006.01)

(52) U.S. Cl.
USPC ..... 368/169; 368/175

(58) Field of Classification Search
USPC ..... 368/127–133, 168–178, 325
See application file for complete search history.

(56) References Cited

U.S. PATENT DOCUMENTS

| | | | | |
|---|---|---|---|---|
| 38,393 | A * | 5/1863 | Jamees | 368/174 |
| 3,638,419 | A * | 2/1972 | Diersbock | 368/175 |
| 7,950,846 | B2 * | 5/2011 | Hessler et al. | 368/169 |
| 8,002,460 | B2 * | 8/2011 | Daout et al. | 368/175 |

FOREIGN PATENT DOCUMENTS

| | | | |
|---|---|---|---|
| CH | 699 081 | A2 | 1/2010 |
| CN | 1427316 | A | 7/2003 |
| CN | 1677283 | A | 10/2005 |
| CN | 1841242 | A | 10/2006 |
| CN | 101156113 | A | 4/2008 |
| CN | 101539754 | A | 9/2009 |
| CN | 101620406 | A | 1/2010 |
| DE | 20 2008 011 659 | U1 | 1/2009 |
| GB | 2 039 389 | A | 8/1980 |

OTHER PUBLICATIONS

Walter, Suitbert. "Beat Haldimann: H2 Resonance Tourbillon" The Purists.com: Beat Haldimann H2. The Purists.com, Mar. 2005. [online] Accessed Oct. 16, 2012. <http://www.thepurists.net/patrons/members/wsw/haldimann/haldimann_h2_2b.htm>.*

* cited by examiner

*Primary Examiner* — Amy Cohen Johnson
*Assistant Examiner* — Matthew Powell
(74) *Attorney, Agent, or Firm* — Muncy, Geissler, Olds & Lowe, P.C.

(57) ABSTRACT

An oscillator system (30) of a mechanical timepiece, comprising: at least one balance wheel (35) that is free to rotate about an axis; and at least one hairspring (31) connecting the at least one balance wheel (35) to a fixed point or to another balance wheel (36), the hairspring (31) including: a first coil (32) connected to the at least one balance wheel (35); and a second coil (33) connected to the fixed point or to the another balance wheel (36); and a transition section (34) connecting the first coil (32) to the second coil (33), wherein an approximately linear restoring torque for the at least one balance wheel (35) is primarily provided by elastic deformation of the transition section (34) and the coils (32, 33), in order to generate an oscillatory motion for the at least one balance wheel (35).

16 Claims, 15 Drawing Sheets

Prior Art

Prior Art

OSCILLATOR SYSTEM

This nonprovisional application claims priority under 35 U.S.C. §119(a) to Hong Kong Patent Application No. 10102613.1, which was filed in Hong Kong on Mar. 12, 2010, and which is herein incorporated by reference.

TECHNICAL FIELD

The invention concerns a hairspring for an oscillator system of a mechanical timepiece.

BACKGROUND OF THE INVENTION

In its most basic form, a mechanical movement consists of a power source, gear train, escapement, oscillator, and indicator. The power source is typically a dropping weight for a clock or a main spring for a watch. The main spring is wound manually or via an auto-winding mechanism. Power in the form of torque is transmitted from the power source via the gear train to increase the angular velocity until it reaches the escapement. The escapement regulates the release of power into the oscillator. The oscillator is in essence a spring-mass system in the form of a pendulum for a clock or balance wheel with hairspring for a watch. It oscillates at a stable natural frequency which is used for timekeeping. As the oscillator amplitude decreases due to dissipative elements, the escapement regularly injects power into the system to compensate based on the state of the oscillator. At the same time, the escapement allows the gear train to move slightly which drives the indicator to display time.

The oscillator is a key component in mechanical movements due to its role in determining time rate. A conventional watch oscillator consists of a balance wheel and hairspring. The balance wheel is attached to the balance staff held in position by one or more bearings which also allows the subassembly to rotate. The typical hairspring follows an Archimedes spiral with equal spacing between each turning. The outer end of the hairspring is attached to a fixed point, and the inner end is attached to the balance staff. The resulting setup can be modeled as a linear spring-mass system with the balance wheel and hairspring providing the inertia and restoring torque, respectively. The hairspring will force the balance wheel into clockwise and counter-clockwise oscillatory rotations around its equilibrium position (or dead spot).

Some high-end mechanical movements consist of two oscillators which may or may not be driven by the same main spring. The two oscillators do not have direct mechanical connection and move independently. The gear train is designed such that the displayed time is the average of the two oscillators, thus averaging out any error in each individual oscillator.

The traditional hairspring with Archimedes spiral has different geometry for over-coil and under-coil where the balance wheel angular displacement is greater or less than its equilibrium position, respectively. This implies that oscillator system dynamic is asymmetric around its equilibrium position with different amplitudes for over-coil and under-coil. Typically watch escapement such as Swiss lever escapement uses asymmetric pallet action with different pallet steepness and moment arm to compensate for this asymmetry. However, this is an imperfect solution as the compensation is only partial.

The traditional twin-oscillator mechanical movement lacks direct mechanical connection between the two oscillators, implying that they do not have an efficient mean of synchronization. The lack of synchronization negatively affects movement accuracy and makes it more difficult to perform diagnostic traditionally based on the movement's acoustic signature.

Referring to FIG. 1, an oscillator 10 of a mechanical timepiece using a traditional single-coil hairspring 12 is illustrated. The traditional single-coil hairspring has only one end that is attached to the balance wheel. The geometry is based on the Archimedes spiral 12. The outer end of the spring 12 is attached to a fixed point via a stud 13, and the inner end of the spring 12 is attached to a balance staff 14 which rotates along with a balance wheel 11. Since the geometry of the hairspring 12 is different when it is in over-coil and under-coil, the dynamic of the oscillator 10 is asymmetric around its equilibrium position as depicted in FIG. 2. The equilibrium position or dead spot is a state or condition of the oscillator where the net torque acting on the balance wheel(s) is/are zero and the hairspring is relaxed. When the balance wheel leaves the equilibrium position, it stresses the hairspring. This creates a restoring torque which, when the balance wheel 11 is released, makes it return to its equilibrium position. As it has acquired a certain speed, and therefore kinetic energy, it goes beyond its dead spot until the opposite torque of the hairspring 12 stops it and obliges it to rotate in the other direction. Thus, the hairspring 12 regulates the period of oscillation of the balance wheel 11.

Turning to FIG. 2, the oscillation of the balance wheel 11 is charted. As the hairspring 12 coils in one direction about its equilibrium position, its amplitude 21 is different from the amplitude 22 when the hairspring 12 coils in the other direction.

In a conventional double escapement-oscillator design, the oscillators are effectively decoupled. Due to manufacturing tolerance, each oscillator has a slightly different natural frequency causing them to periodically shift into and out of phase. This contributes to the movement inaccuracy as each oscillator fights another to regulate the time. Furthermore, the design makes it difficult for a watchmaker to adjust the oscillators as conventional diagnostic tools measure a single oscillator's frequency, amplitude, and other performance criteria based on its acoustic signature. Having two out-of-phase oscillators mean that the acoustic signature is scrambled and difficult to decode.

There is a desire for an oscillator system that ameliorates some of the problems of traditional mechanical timepieces.

SUMMARY OF THE INVENTION

In a first preferred aspect, there is provided an oscillator system of a mechanical timepiece, comprising:

- at least one balance wheel that is free to rotate about an axis; and
- at least one hairspring connecting the at least one balance wheel to a fixed point or to another balance wheel, the hairspring including:
  - a first coil connected to the at least one balance wheel; and
  - a second coil connected to the fixed point or to the another balance wheel; and
  - a transition section connecting the first coil to the second coil,
- wherein an approximately linear restoring torque for the at least one balance wheel is primarily provided by elastic deformation of the transition section and the coils, in order to generate an oscillatory motion for the at least one balance wheel.

If there are at least two hairsprings, the hairsprings may be merged to form a single co-planar hairspring with multiple arms, each arm having two coils.

The transition section may contain a point of inflection.

The least one balance wheel may be one of two identical balance wheels, the two identical balance wheels being connected to each other by a hairspring to generate a synchronized oscillatory motion for the two balance wheels that is antisymmetric around an equilibrium position of the hairspring.

The oscillator system may further comprise two hairsprings each with a single coil, each hairspring being attached to one balance wheel at its inner end and to a fixed point via a stud at its outer end, wherein the two single-coil hairsprings contributes to the restoring torque to each balance wheel.

The oscillator system may further comprise a user-operated clamp to secure the transition section of the hairspring, the clamp dividing the oscillator system into two isolated oscillators and forcing the oscillator system to oscillate at a second mode at a higher natural frequency than a first mode.

The oscillator system may further comprise at least two balance wheels, the at least two balance wheels are interconnected by hairsprings forming a loop arrangement such that all the balance wheels oscillate in a synchronized manner.

The oscillator system may further comprise at least two balance wheels, the at least two balance wheels are interconnected by hairsprings forming a series arrangement such that all the balance wheels oscillate in a synchronized manner.

The oscillator system may further comprise at least two balance wheels, the at least two balance wheels are interconnected by hairsprings forming a parallel arrangement such that all the balance wheels oscillate in a synchronized manner.

The at least one balance wheel may be a single balance wheel that is connected by at least two hairsprings or a single hairspring with multiple arms, each arm having two coils, to at least two fixed points via studs in an axially-symmetric arrangement in order to minimise friction at the balance wheel and reduce the probability of collision among arms of the single hairspring with multiple arms, each arm having two coils, by having the majority of the deformation of hairspring occurring near the distal end of the arms.

The hairspring may be antisymmetric or symmetric.

The present invention provides a hairspring that enforces an antisymmetric system dynamic around its equilibrium position. The hairspring has at least two distinct identical coils such that one section is in over-coil while another section is simultaneously in under-coil. The tips of the coils of the hairspring are connected to balance wheels. Consequently, one type of hairspring is an antisymmetric double-coil hairspring with two distinct coils in the same direction. Another type of hairspring is a symmetric double-coil hairspring with two distinct coils in opposite directions.

The hairspring is advantageously used for the synchronization of two or more oscillators in a series, parallel, or loop arrangement. Also, a double-coil hairspring may be used in a variable frequency oscillator.

BRIEF DESCRIPTION OF THE DRAWINGS

An example of the invention will now be described with reference to the accompanying drawings, in which.

DETAILED DESCRIPTION OF THE DRAWINGS

Figure 1:
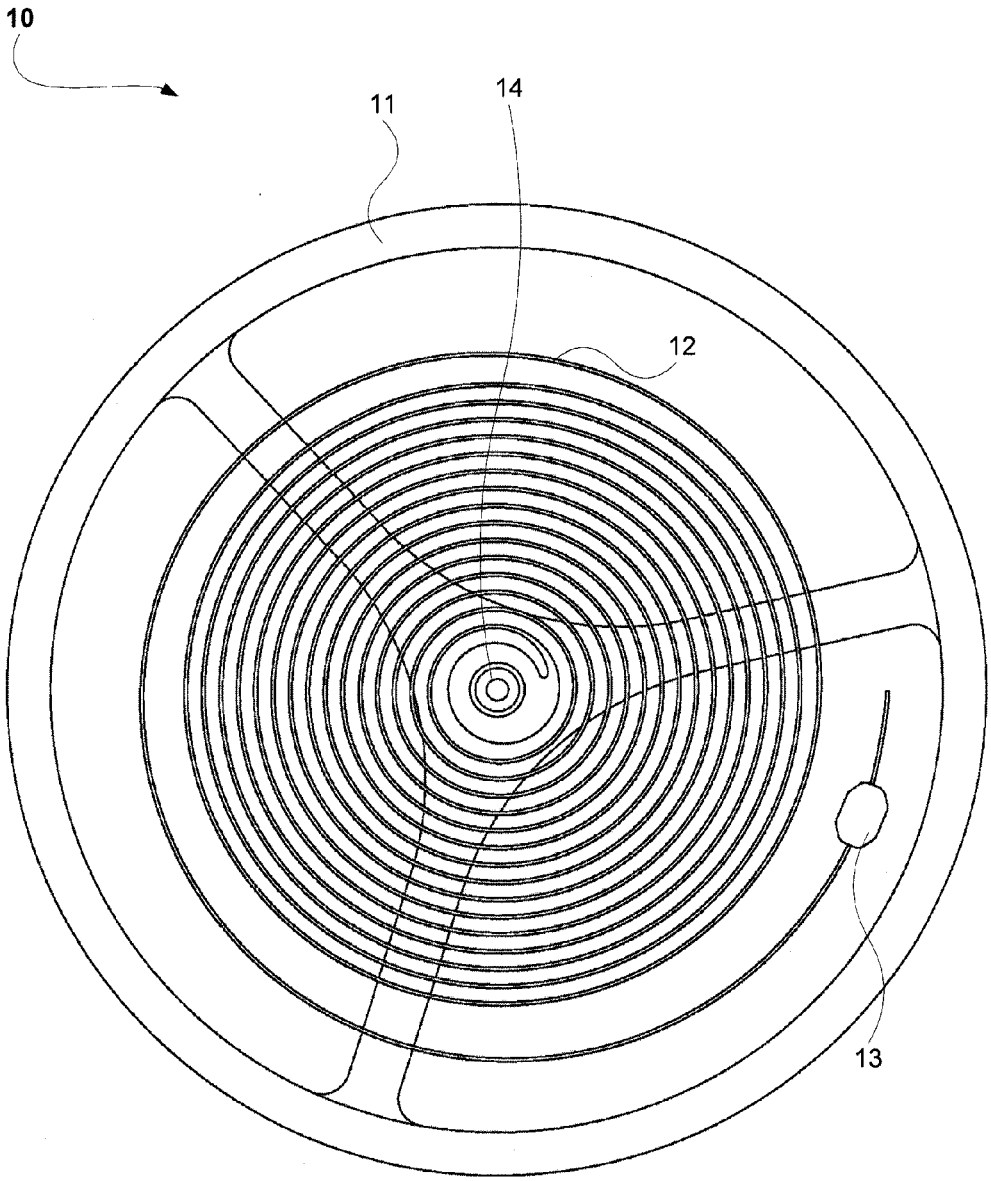
FIG. 1 is a diagram of an oscillator with one balance wheel and a traditional single-coil hairspring with an Archimedes spiral.
Figure 2:
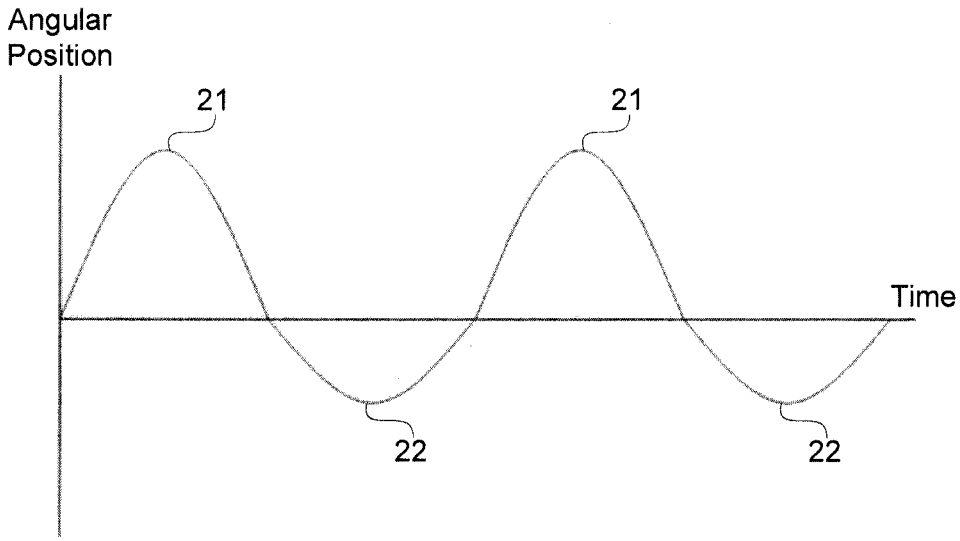
FIG. 2 is a qualitative plot on the angular position versus time for the traditional single-coil hairspring of FIG. 1.
Figure 3:
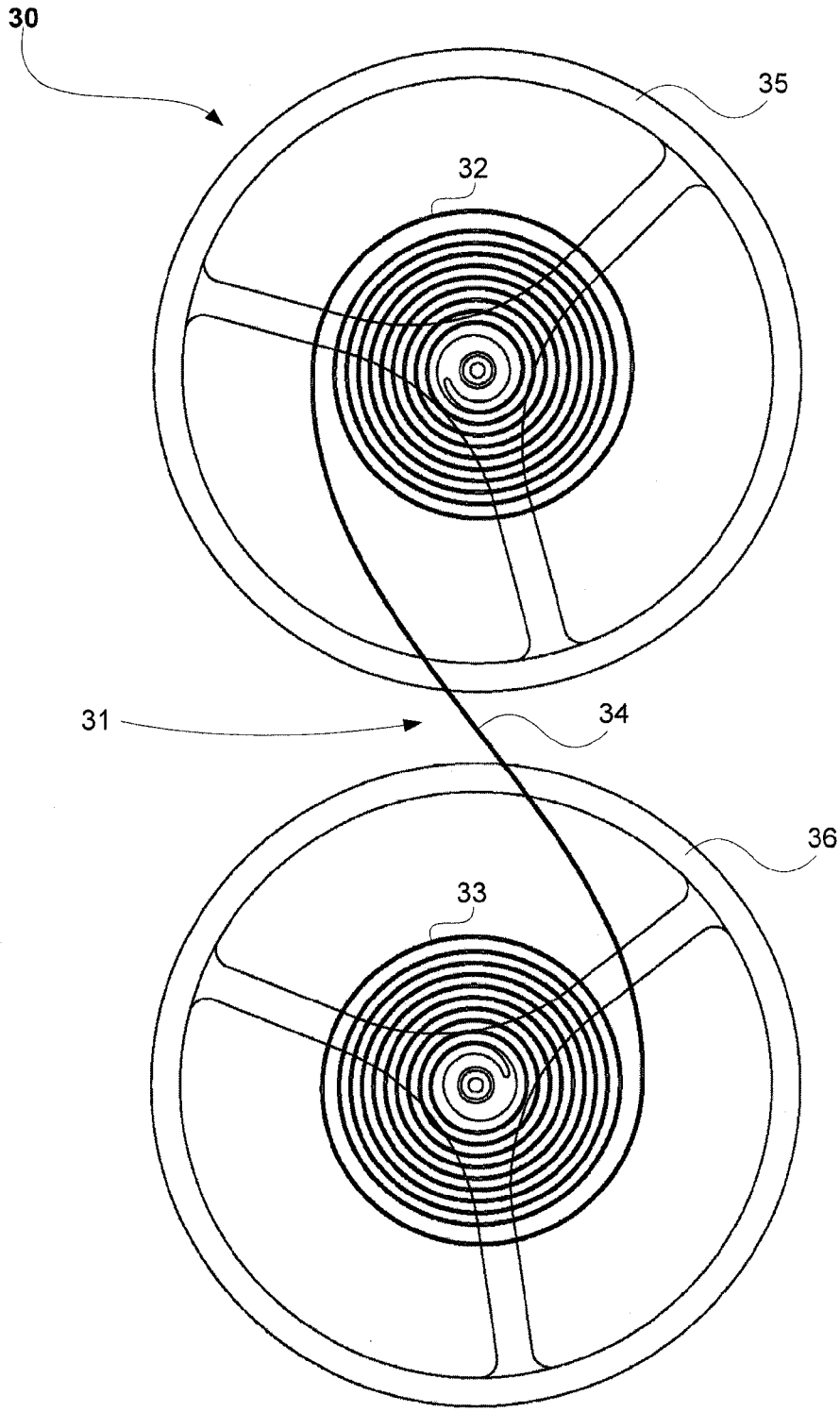
FIG. 3 is a diagram of an oscillator with two balance wheels and an interconnecting double-coil hairspring based on an antisymmetric design.

Referring to FIG. 3, an embodiment of an oscillator 30 with a double-coil hairspring 31 based on an antisymmetric geometry is illustrated. The double-coil hairspring 31 has two distinct coils 32, 33. The coils 32, 33 may or may not necessarily follow an Archimedes spiral. The coils 32, 33 are mechanically linked via a transition section 34 that has a point of inflection near the center of the transition section 34. The double-coil hairspring 31 has both of its ends attached to two identical balance wheels 35, 36.

The oscillator 30 has two balance wheels 35, 36 directly connected by a single hairspring 31. Therefore this spring-mass system can be approximated as an under-damped second-order system with two modes of vibration. The approximation assumes that the balance wheels 35, 36 are point inertias with a mass-less hairspring. However, even assuming balance wheels of distributed inertia and a hairspring of finite mass, the two aforementioned modes of vibration tend to dominate over the other modes which die out quickly. If the balance wheels 35, 36 are identical and connected by an antisymmetric hairspring 31 as depicted in FIG. 3, the mode with the lower fundamental frequency results in the balance wheels 35, 36 oscillating in phase and is the most stable. The mode with the higher frequency results in the balance wheels 35, 36 oscillating completely out of phase but is less stable.

Figure 4:
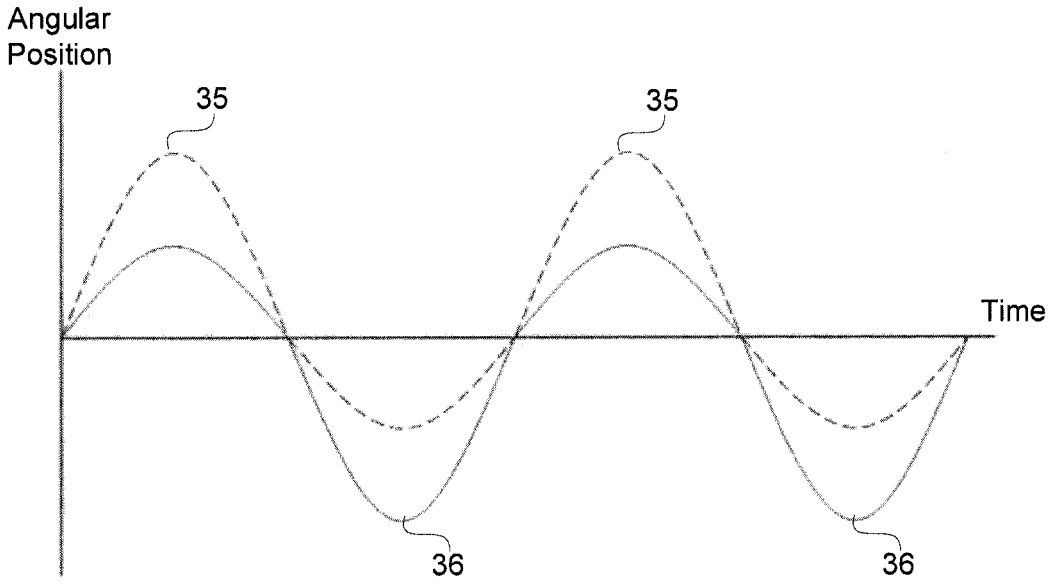
FIG. 4 is a qualitative plot on the angular position versus time for the oscillator of FIG. 3.

Referring to FIG. 4, the oscillator 30 can be made to settle to the most stable fundamental mode with a proper escapement design in a mechanical movement despite the existence of an initial transient response. Any motion by one balance wheel 35 is mirrored by the other balance wheel 36 in the next cycle. Theoretically, this design yields a perfectly antisymmetric system dynamic around the equilibrium position of the hairspring 30 even though each individual motion of the balance wheel 35, 36 may be asymmetric due to a varying spring constant. This design completely bypasses the problem of the asymmetric dynamics in a traditional hairspring for which current escapements are required to compensate imperfectly using asymmetric pallet actions.

Figure 5:
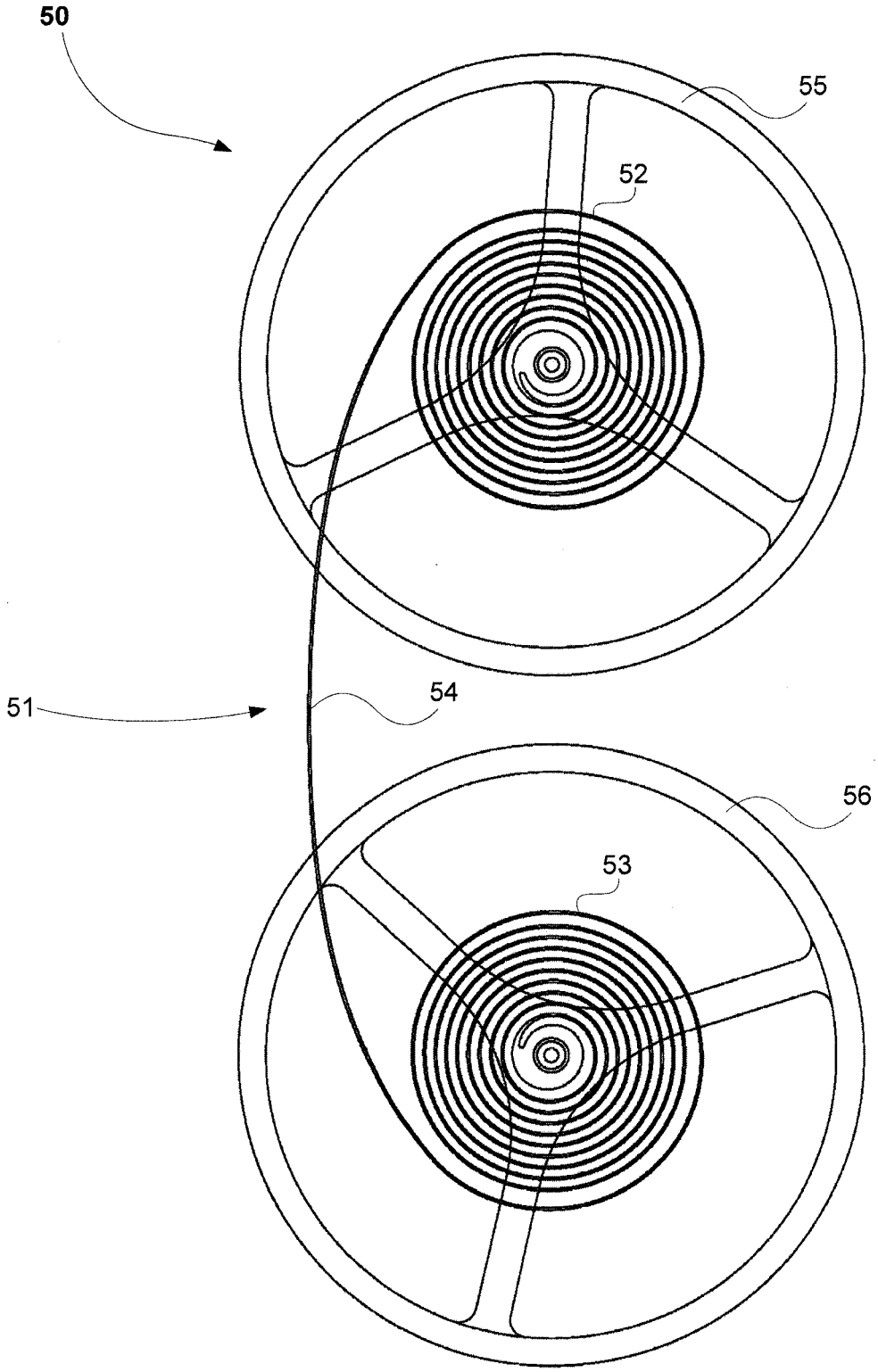
FIG. 5 is a diagram of an oscillator with two balance wheels and an interconnecting double-coil hairspring based on a symmetric design.

Referring to FIG. 5, an embodiment of an oscillator 50 with a novel double-coil hairspring 51 based on a symmetric geometry is illustrated. There are two distinct coils 52, 53 mechanically connected via a transition section 54. The two ends of the hairspring 51 are attached to two identical balance wheels 55, 56. The resulting design also yields an antisymmetric system dynamic around the equilibrium position of the hairspring 51.

The coils 32, 33, 52, 53 may follow an Archimedes spiral. However, not all embodiments require the coils 32, 33, 52, 53 to follow an Archimedes spiral because the mechanics of the double-coil hairspring 31, 51 are different to a conventional hairspring. In a conventional hairspring, the restoring torque is primarily provided by elastic deformation in the form of tension and compression of the coils of the conventional hairspring themselves. In a double-coil hairspring 31, 51, the restoring torque is primarily provided by elastic deformation in the form of bending of the transition section 34, 54 between the two distinct coils 32, 33, 52, 53 being forced into one of the coils 32, 33, 52, 53. To a lesser extent, tensile expansion and compressive contraction of the hairspring 31, 51 provide some restoring torque to each balance wheel 35, 36, 55, 56. Proper hairspring curvature design, especially in the transition section 34, 54 between the two distinct coils 32, 33, 52, 53, produces a torque curve that can be arbitrarily close to linear at each balance wheel 35, 36, 55, 56.

A traditional method to achieve antisymmetric system dynamic is to use two counter-coiling hairsprings attached to a single balance wheel in a double-decker layout. As the balance wheel oscillates, one hairspring is in over-coil while another hairspring is simultaneously in under-coil. In contrast, the novel double-coil hairspring 31, 51 of the embodiments described has a number of advantages. It produces a flatter design and therefore a thinner movement as no stacking is required. Since a thick movement makes a cumbersome watch, a thin movement is highly desirable in terms of portability and aesthetic attractiveness. The traditional double-decker hairspring requires the two separate hairsprings to be properly aligned relative to each other while the novel double-coil hairspring 31, 51 naturally self-aligns at its relaxed state. Finally, the traditional double-decker hairspring cannot be integrated into a double escapement-oscillator mechanical movement to achieve oscillator synchronization whereas the novel double-coil hairspring 31, 51 is based on such an oscillator system.

Figure 6:
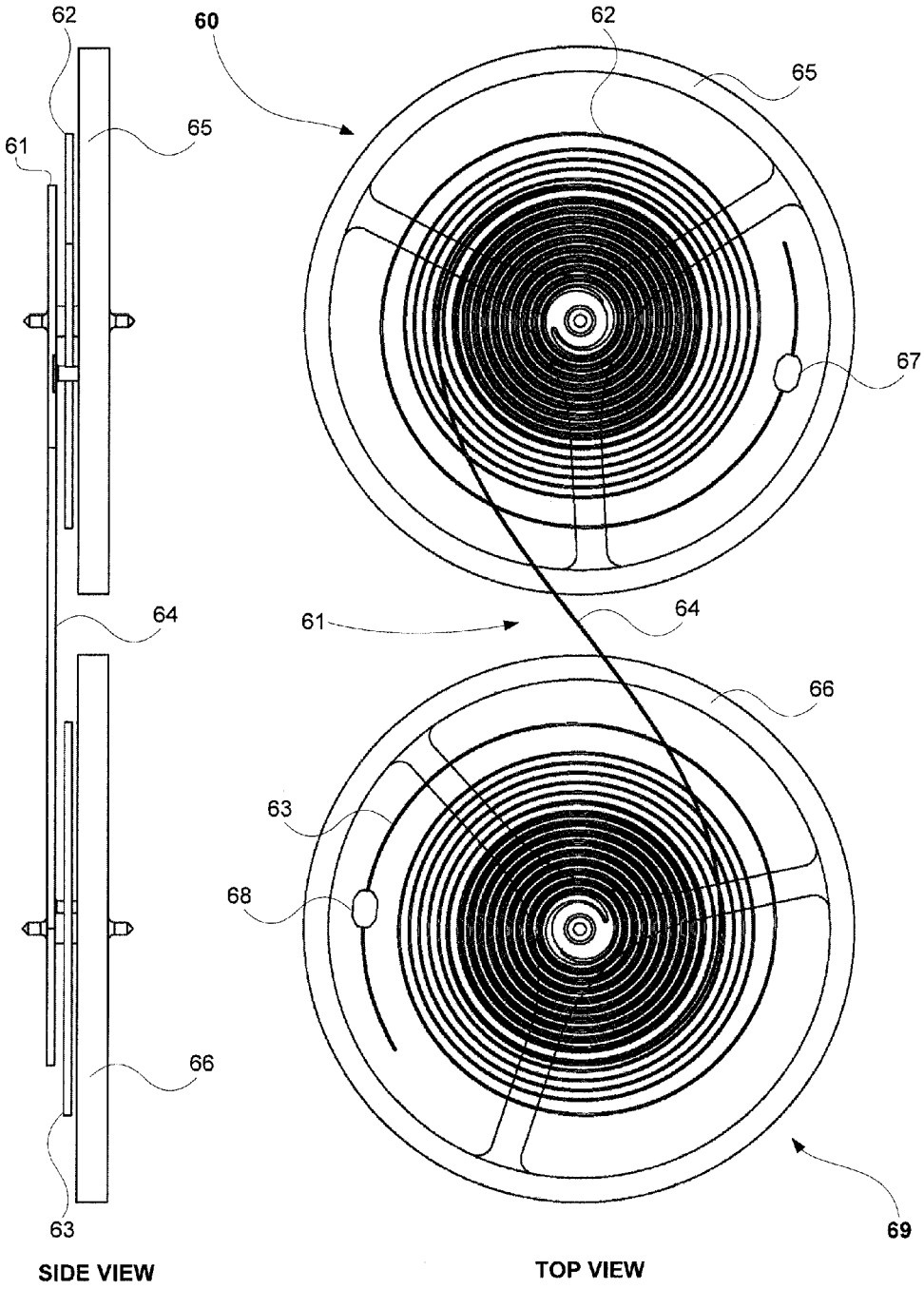
FIG. 6 is a diagram of an oscillator with two balance wheels each with their own independent traditional single-coil hairspring and linked together by a third interconnecting hairspring in a tandem arrangement.
Figure 7:
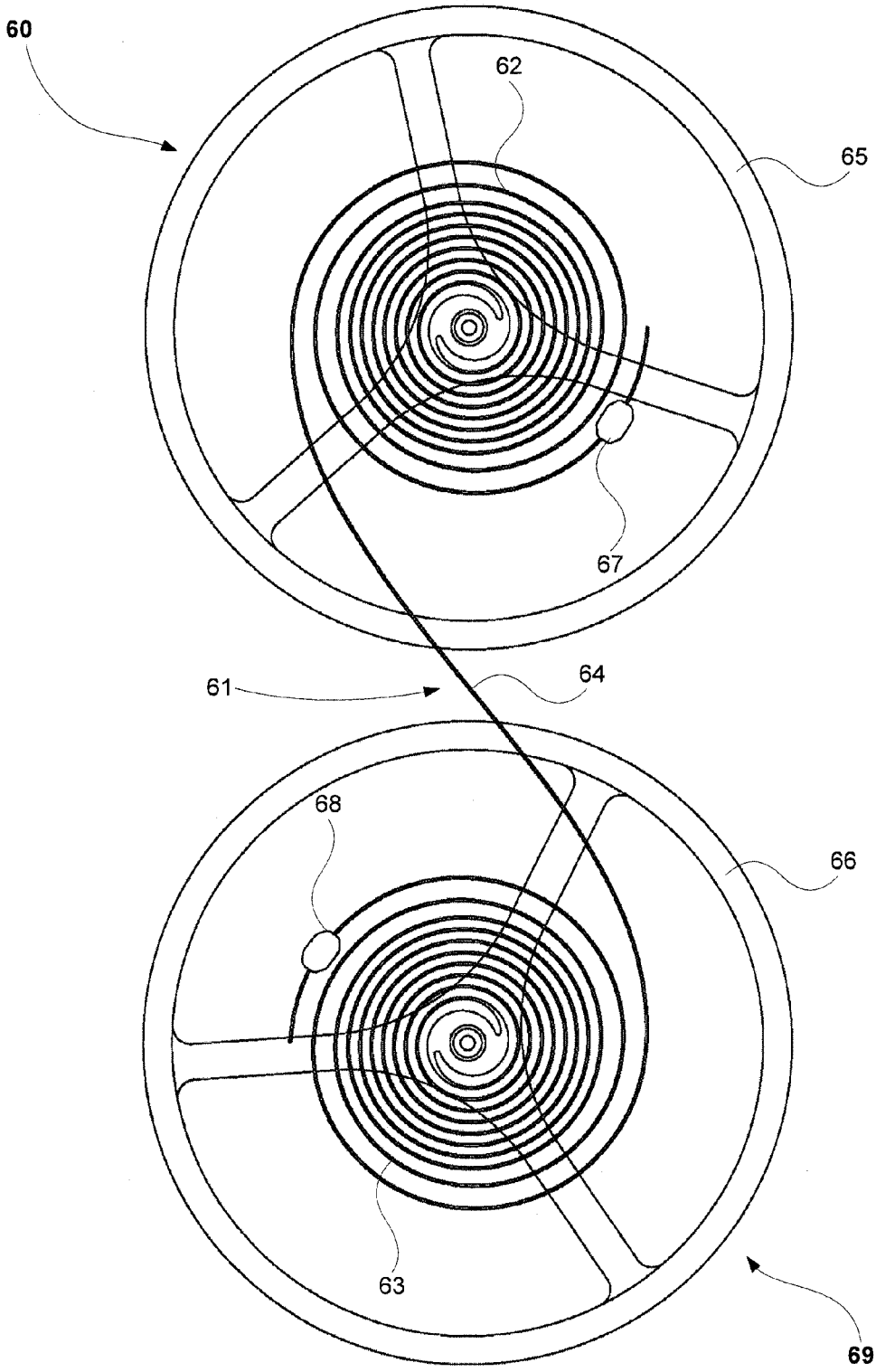
FIG. 7 is a diagram of an oscillator with two balance wheels each and a twin interconnected double-arm hairspring in a co-planar arrangement where one single-coil arm is attached to each balance wheel and a third arm is a double-coil hairspring with a transition section connecting both balance wheels.

Referring to FIGS. 6 and 7, an oscillator system with a double escapement-oscillator mechanical movement is provided. The oscillator system moves in phase which is a particularly desirable characteristic in a double escapement-oscillator system which is used in the high-end mechanical movements. The double-coil shaped hairspring 61 can be used to provide a coupling between two otherwise completely isolated oscillators 60, 69. Each oscillator 60, 69 is able to retain its own distinct hairspring 62, 63, and a third interconnecting hairspring 64 is used to link the isolated oscillators 60, 69 together. The inner ends of hairsprings 62, 63 are connected to the balance wheels 65, 66, respectively, and the outer ends of hairsprings 62, 63 are fixed via studs 67, 68, respectively. The distinct and independent hairsprings 62, 63 provide the restoring torque for each balance wheel 65, 66. The interconnecting hairspring 61 provides some restoring torque and a coupling torque between the balance wheels 65, 66 such that energy can be transmitted between the two oscillators 60, 69.

The difference between the embodiments depicted in FIGS. 6 and 7 is that FIG. 6 shows three separate hairsprings in tandem arrangement, that is, two independent single-coil hairsprings 62, 63 and one interconnecting double-coil hairspring 61. The embodiment of FIG. 7 merges the three aforementioned hairsprings into a single co-planar unit with multiple arms. The embodiment of FIG. 7 is more compact but increases the risk of collision between adjacent arms. Subsequent embodiments depicted in FIGS. 8, 9, 10, 14 and 15 describe a hairspring structure based on multiple arms. Such structures are all based on the merging of two or more separate hairsprings in the manner described above.

The third interconnected hairspring 64 enables synchronization of the two oscillators 60, 69. If the oscillators 60, 69 are synchronized, consistent timekeeping regulation and a coherent acoustic signature is provided. Movement accuracy is achieved and adjustment of the oscillators 60, 69 by a watchmaker is easier.

The strength of the third interconnecting hairspring 64 is adjustable to determine the strength of the coupling to each independent hairspring 62, 63. At one extreme, the interconnecting hairspring 64 has zero strength, that is, non-existent. This means the two oscillators 60, 69 are completely decoupled like in a traditional double escapement-oscillator mechanical movement. At the other extreme, the interconnecting hairspring 64 completely dominates the individual hairsprings 62, 63 such that it provides all the restoring torque for both balance wheels 65, 66. Generally, a strong interconnecting hairspring 64 means a strong coupling and a faster synchronization rate between the two balance wheels 65, 66. The strength of the interconnecting hairspring 64 is tuned to fit anywhere within the entire spectrum between the two extremes. The interconnecting hairspring 64 is nominally a separate component from the individual hairsprings 62, 63 to be stacked at a different level as shown in the side view at the left side of FIG. 6. However, using micro-fabrication manufacturing technology, it is possible to produce a single-unit hairspring with twin interconnected double-arm spirals that serves both as the individual hairsprings 62, 63 and interconnecting hairspring 64. This simplifies the assembly process and produces a flatter design, allowing for a thinner movement.

Figure 8:
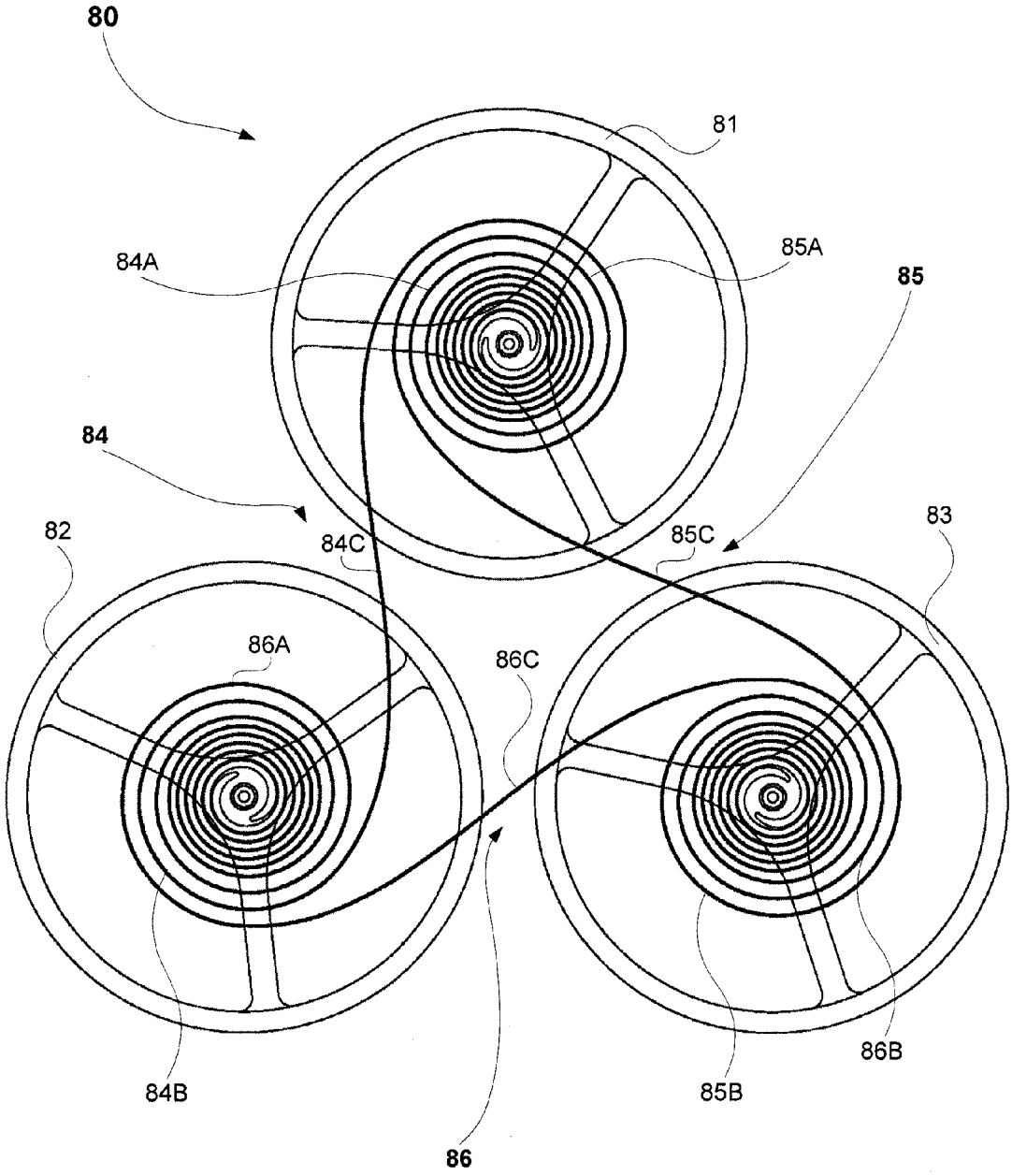
FIG. 8 is a diagram of an oscillator with three balance wheels that are interconnected by double-coil hairsprings in a loop arrangement.
Figure 9:
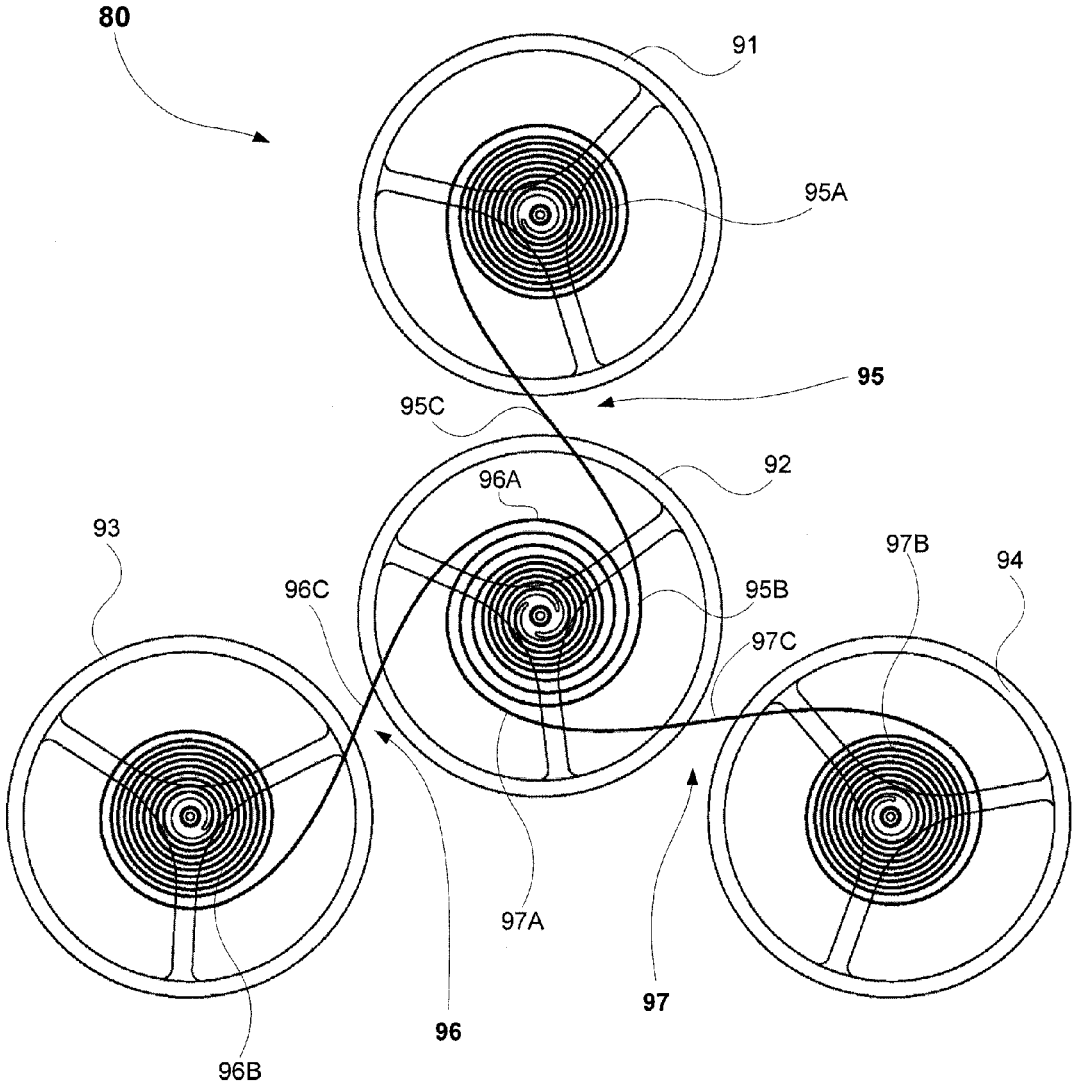
FIG. 9 is a diagram of an oscillator with four balance wheels that are interconnected by double-coil hairsprings in a parallel arrangement.
Figure 10:
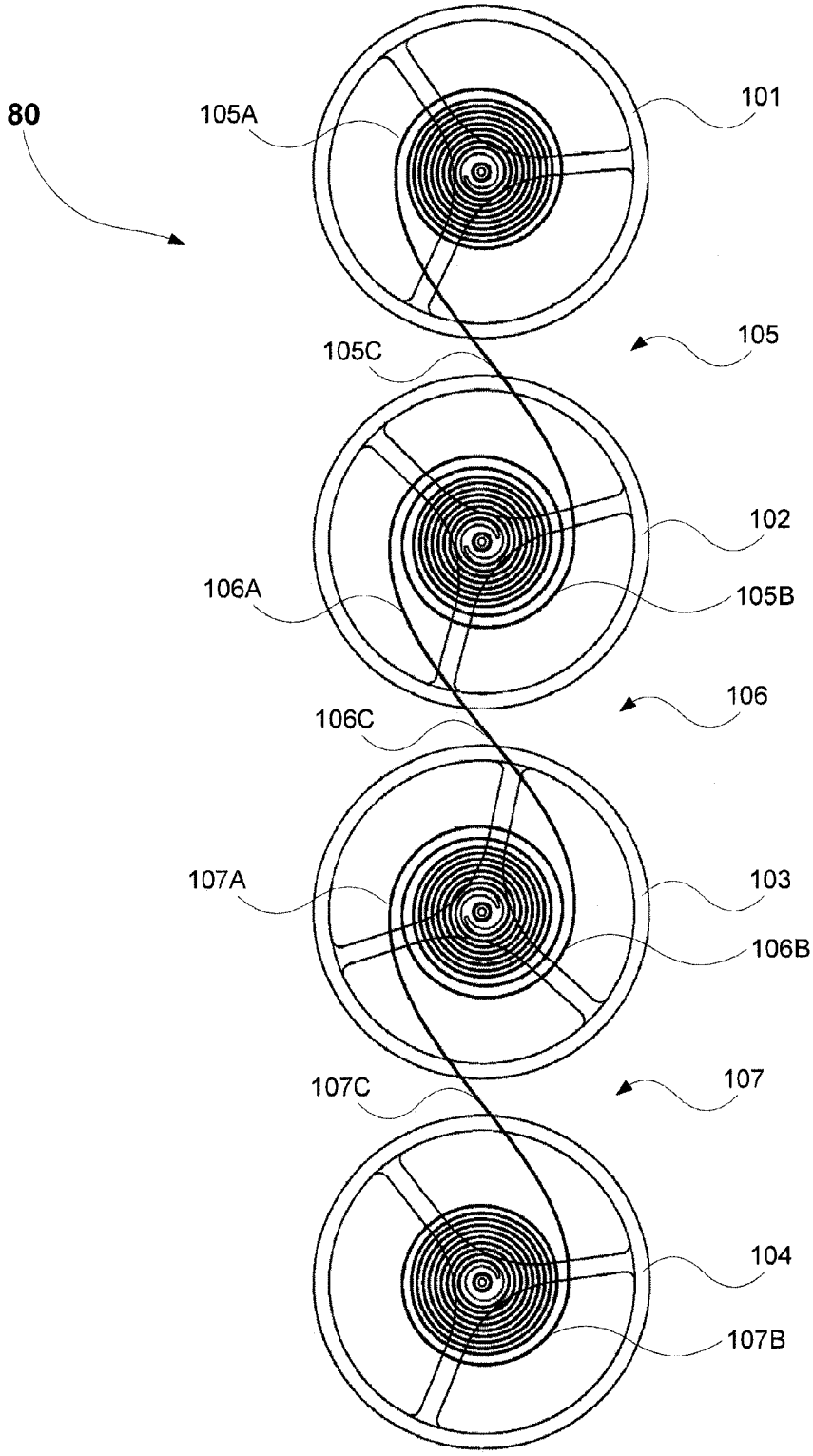
FIG. 10 is a diagram of an oscillator with four balance wheels that are interconnected by double-coil hairsprings in a series arrangement.

Referring to FIGS. 8 to 10, it is also possible to connect three or more oscillators in a series, parallel, or loop fashion to produce an augmented system 80. The augmented system 80 of oscillators is able to synchronize given a proper escapement design. With a greater amount of individual oscillators the frequency averaging effect caused by the synchronization yields a more accurate movement but the oscillator system 80 becomes more complex.

FIG. 8 depicts an oscillator with three balance wheels 81, 82, 83 in a loop arrangement. The balance wheels 81, 82, 83 are connected by arms 84, 85, 86. The arms 84, 85, 86 have two coils 84A, 84B, 85A, 85B, 86A, 86B, respectively. A first balance wheel 81 is connected to a second balance wheel 82 by a first arm 84.

The first arm 84 has a first coil 84A connected to the first balance wheel 81, a second coil 84B connected to the second balance wheel 82 and a transition section 84C. The first balance wheel 81 is also connected to a third balance wheel 83 by a second arm 85. The second arm 85 has a first coil 85A connected to the first balance wheel 81, a second coil 85B connected to the third balance wheel 83 and a transition section 85C. The second balance wheel 82 is also connected to the third balance wheel 83 by a third arm 86. The second arm 86 has a first coil 86A connected to the second balance wheel 82, a second coil 86B connected to the third balance wheel 83 and a transition section 86C. The arms 84, 85, 86 provide the restoring storing torque for each balance wheel 81, 82, 83, respectively.

FIG. 9 depicts an oscillator with four balance wheels 91, 92, 93, 94 in a parallel arrangement. The balance wheels 91, 92, 93, 94 are connected by arms 95, 96, 97, 98. A first balance wheel 91 is connected to a second balance wheel 92 by a first arm 95. The first arm 95 has a first coil 95A connected to the first balance wheel 91, a second coil 95B connected to the second balance wheel 92 and a transition section 95C. The second balance wheel 92 is also connected to a third balance wheel 93 by a second arm 96. The second arm 96 has a first coil 96A connected to the second balance wheel 92, a second coil 96B connected to the third balance wheel 93 and a transition section 960. The second balance wheel 92 is also connected to a fourth balance wheel 94 by a third arm 97. The third arm 97 has a first coil 97A connected to the second balance wheel 92, a second coil 97B connected to the fourth balance wheel 94 and a transition section 97C. The arms 95, 96, 97 provide the restoring storing torque for each balance wheel 91, 92, 93, 94.

FIG. 10 depicts an oscillator with four balance wheels 101, 102, 103, 104 in a series arrangement. The balance wheels 101, 102, 103, 104 are connected by arms 105, 106, 107. A first balance wheel 101 is connected to a second balance wheel 102 by a first arm 105. The first arm 105 has a first coil 105A connected to the first balance wheel 101, a second coil 105B connected to the second balance wheel 102 and a transition section 105C. A second balance wheel 102 is also connected to a third balance wheel 103 by a second arm 106. The second arm 106 has a first coil 106A connected to the second balance wheel 102, a second coil 106B connected to the third balance wheel 103 and a transition section 106C. The third balance wheel 103 is also connected to a fourth balance wheel 104 by a third arm 107. The third arm 107 has a first coil 107A connected to the third balance wheel 103, a second coil 107B connected to the fourth balance wheel 104 and a transition section 107C.

Any combination of the arrangements of FIGS. 8 to 10 is also possible.

The oscillator system of FIGS. 3 and 5 possesses two modes of vibration with two different natural frequencies. In addition to the fundamental mode, it is possible to intentionally drive the oscillator system to oscillate at a second higher natural frequency. The second mode results in the two balance wheels completely out of phase with the midpoint of the transition section 34, 54 remaining relatively stationary. Essentially, the oscillator system behaves as two distinct and isolated oscillators. This second mode can be explicitly enforced by placing a clamp on the hairspring transition section and thus securing it.

Figure 11:
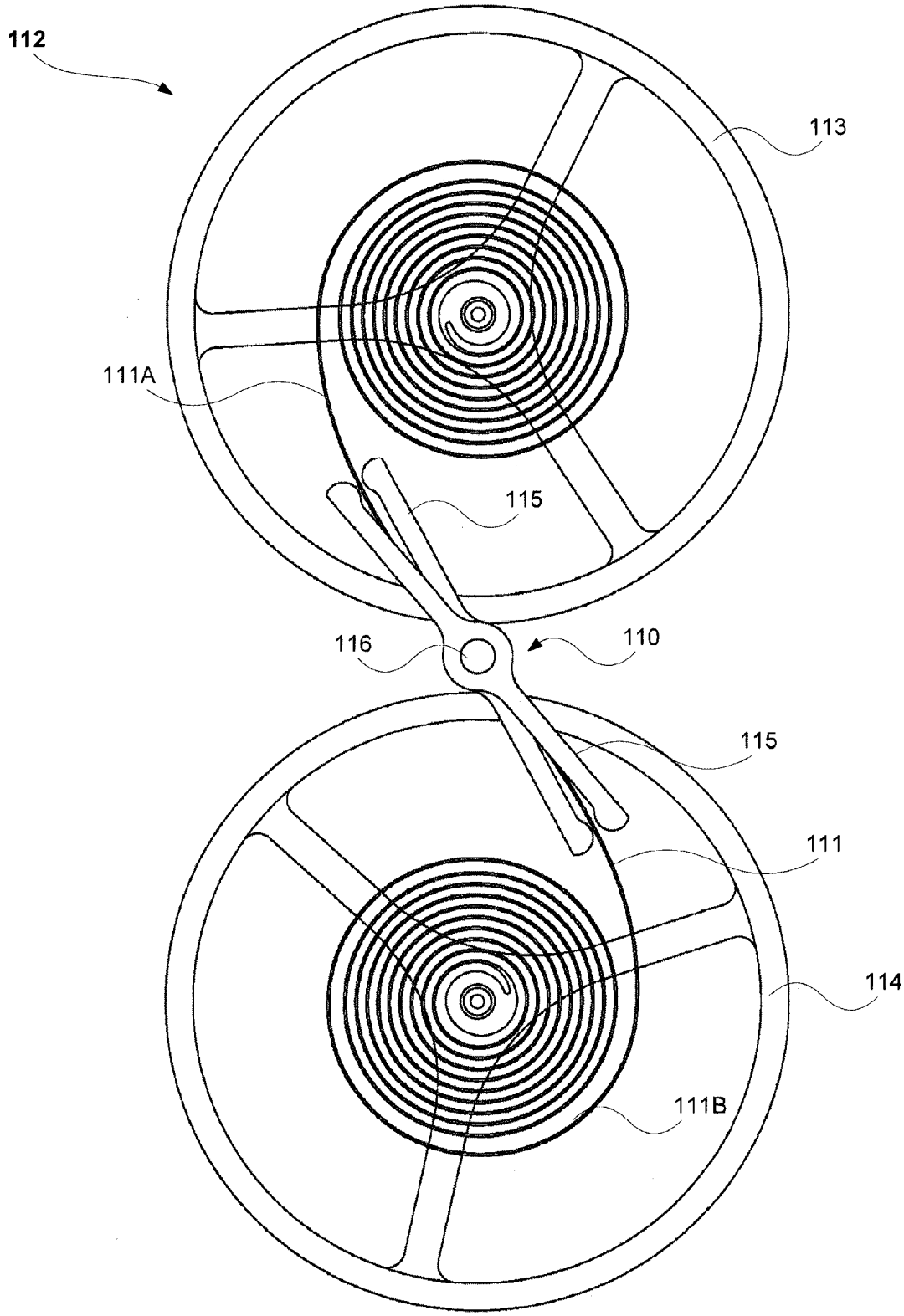
FIG. 11 is a diagram of an oscillator with two balance wheels and an interconnecting double-coil hairspring based on an antisymmetric design with a clamp to secure a transition section such that the two balance wheels become two isolated oscillators with a higher natural frequency.

Referring to FIG. 11, a clamp 110 is provided that secures the midpoint of the double-coil hairspring 111 of an oscillator 112. The clamp 110 comprises two clamp arms 115 pivotally connected by a centrally positioned clamp hinge 116. When the clamp arms 115 are closed to cause the tips of the clamp arms 115 to make contact with other, this divides the double-coil hairspring 111 into two isolated single-coil sections 111A, 111B. The balance wheels 113, 114 oscillate at the second natural frequency.

The clamp 110 is a user-operated mechanism that can clamp the hairspring 111 which allows the mechanical movement to switch between low and high frequency modes. The clamp 110 is useful in chronograph that acts as a timekeeper and a stopwatch. The low frequency mode is the nominal mode for normal timekeeping when high resolution is not critical but low wear and tear is necessary. The high frequency mode is used for a stopwatch where high resolution is desirable.

Figure 12:
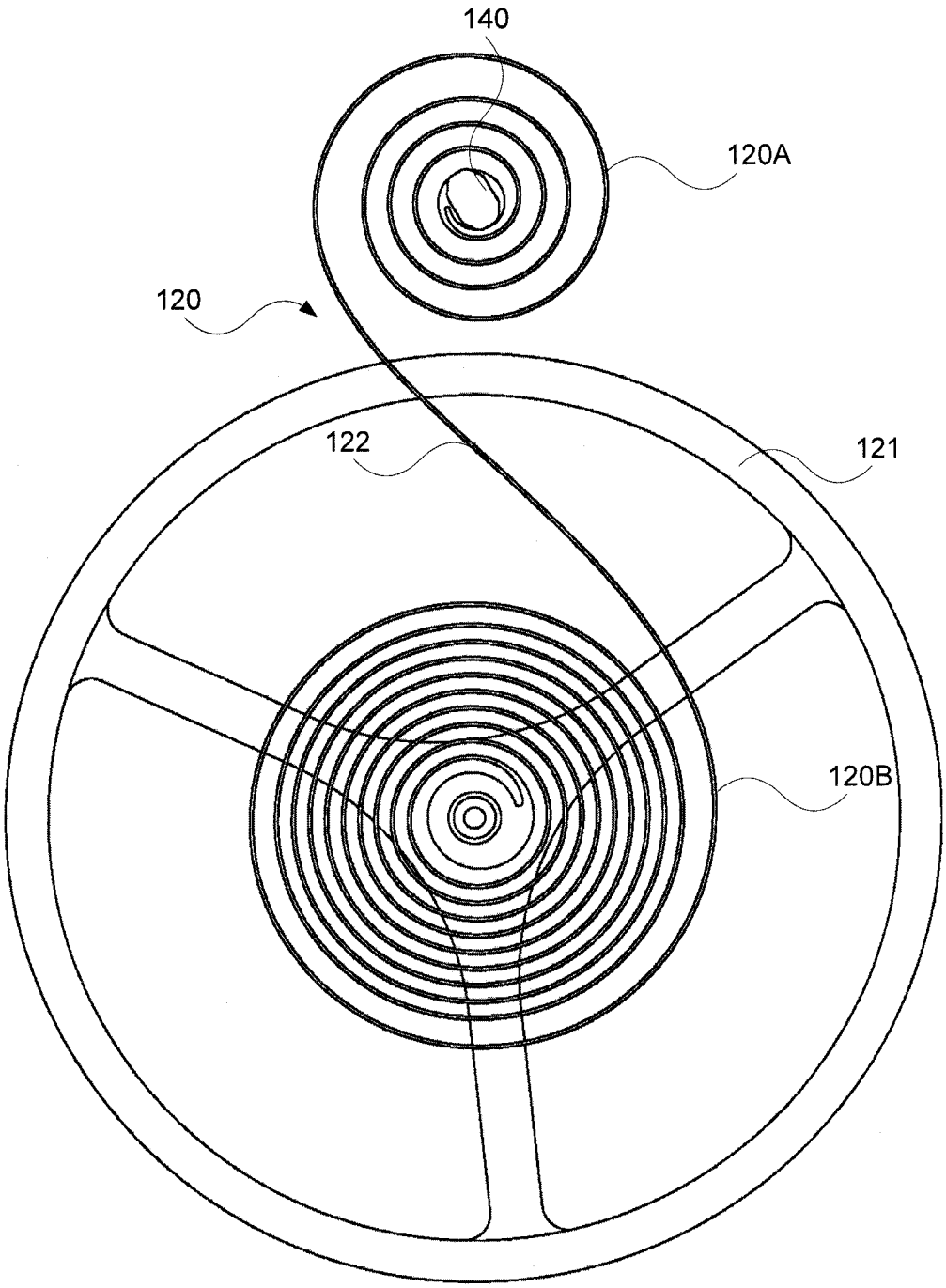
FIG. 12 is a diagram of an oscillator with one balance wheel connected to the end of a double-coil hairspring with a point of inflection and the other end of the double-coil hairspring is fixed via a stud.
Figure 13:
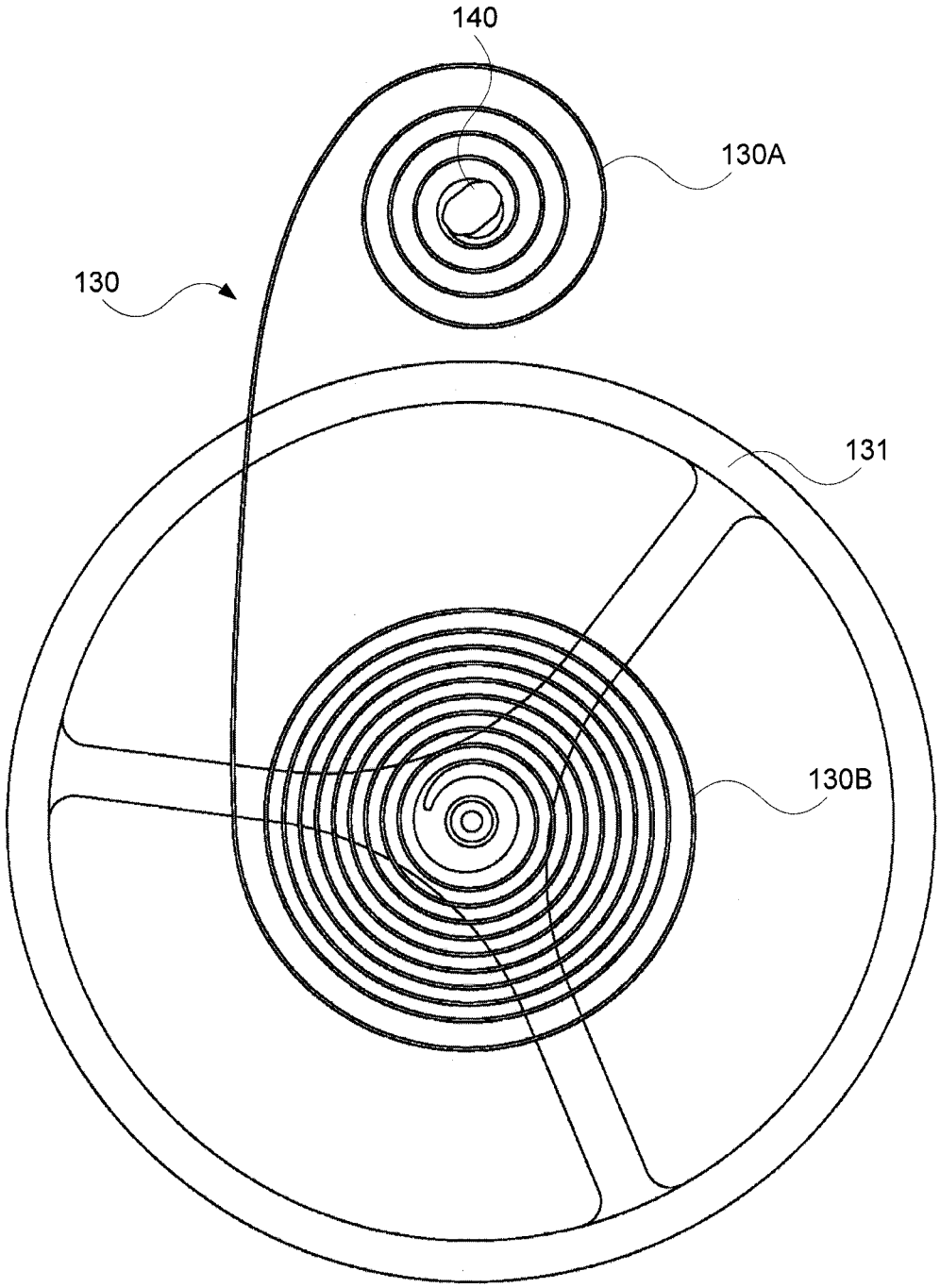
FIG. 13 is a diagram of an oscillator with one balance wheel connected to the end of a double-coil hairspring without a point of inflection and the other end of the double-coil hairspring is fixed via a stud.

Referring to FIGS. 12 and 13, another embodiment of the double-coil hairspring 120, 130 uses only one free balance wheel 121, 131 attached to one end of the hairspring 120, 130. FIG. 12 has a hairspring 120 with a point of inflection at a transition section 122. FIG. 13 has a hairspring 130 without a point of inflection. Unlike the other embodiments, the other end is fixed via a stud 140, resulting in a design with asymmetric boundary conditions. This makes the entire design asymmetric. For this design to achieve the same symmetric oscillator system dynamic, the hairspring geometry itself cannot be antisymmetric or symmetric. There are a variety of parameters that can be adjusted to compensate for the asymmetric boundary conditions. For example, the two coil sections 120A, 120B, 130A, 130B have a different number of coils with different and continuously variable spacing distance between each turning and/or the width of the hairspring is adjusted along the length of the hairspring.

Figure 14:
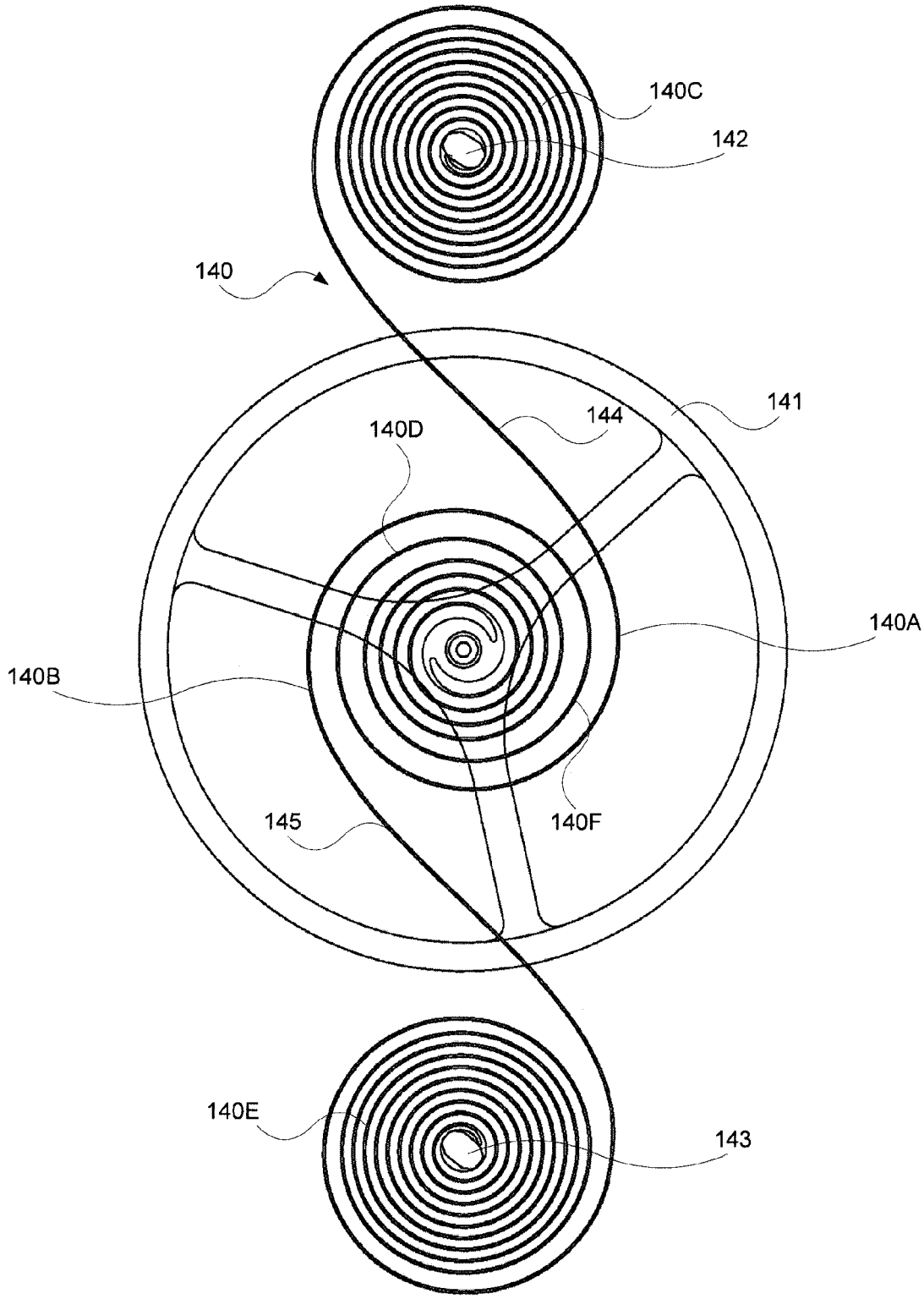
FIG. 14 is a diagram of an oscillator with one balance wheel and a double-coil double-arm hairspring with points of inflection for each arm and the arms originate from a hub connected to the balance wheel and end at fixed points.
Figure 15:
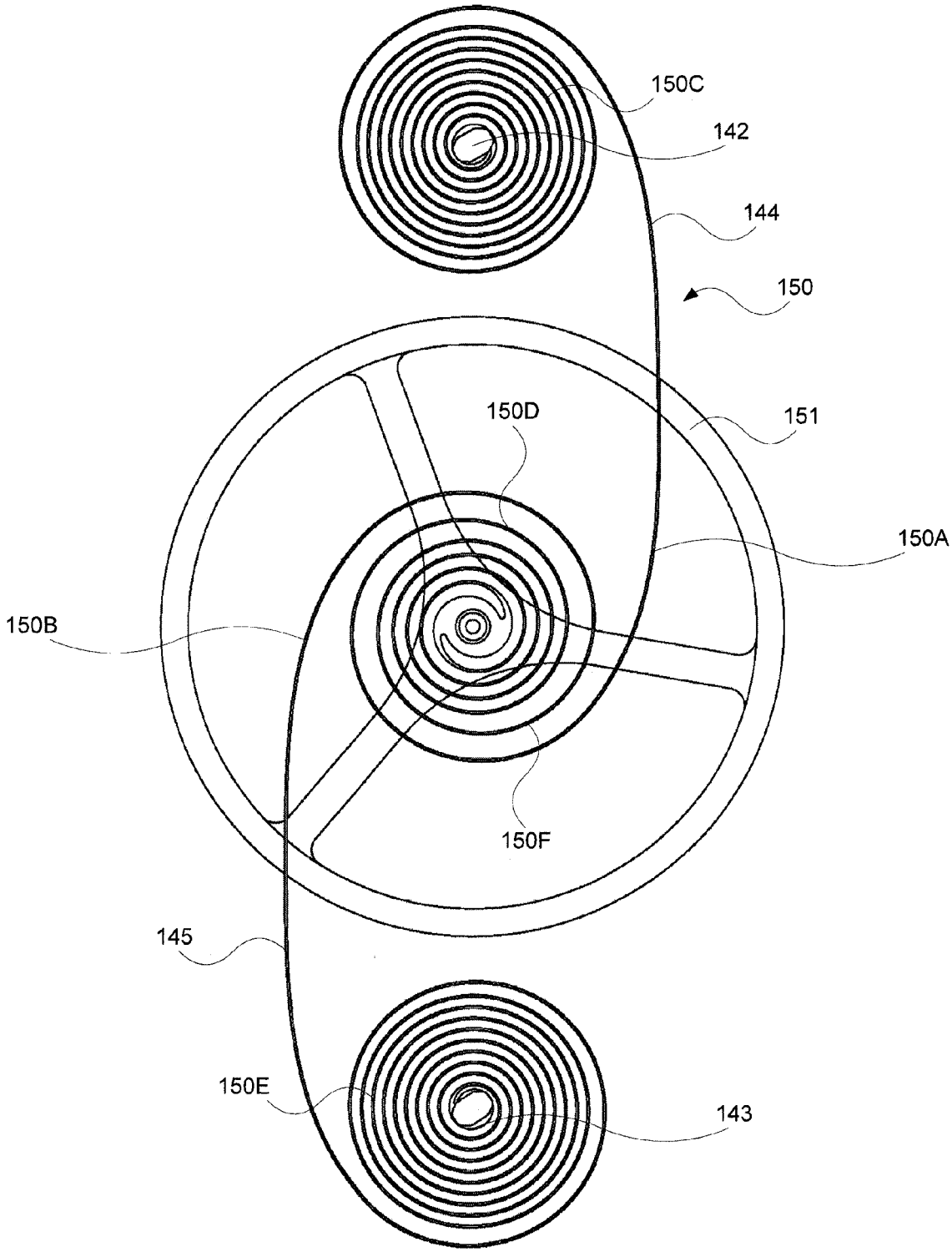
FIG. 15 is a diagram of an oscillator with one balance wheel and a double-coil double-arm hairspring without a point of inflection and the arms originate from a hub connected to the balance wheel and end at fixed points.

Referring to FIGS. 14 and 15, it is possible to create an oscillator with one free balance wheel 141, 151 and two fixed ends. A double-coil double-arm hairspring 140, 150 can link the balance wheel 141, 151 to the two fixed ends via studs 142, 143 for hairsprings.

FIG. 14 depicts a hairspring 140 with points of inflection at transition sections 144, 145. The hairspring 140 has two arms 140A, 140B. A first arm 140A has a first coil 140C connected to a first stud 142. A second coil 140D of the first arm 140A is connected to the balance wheel 141. A second arm 140B has a first coil 140E connected to a second stud 143. A second coil 140F of the second arm 140B is also connected to the balance wheel 141.

FIG. 15 depicts a hairspring 150 without a point of inflection at transition sections 144, 145. The hairspring 150 has two arms 150A, 150B. A first arm 150A has a first coil 150C connected to a first stud 142. A second coil 150D of the first arm 150A is connected to the balance wheel 151. A second arm 150B has a first coil 150E connected to a second stud 143. A second coil 150F of the second arm 150B is also connected to the balance wheel 151.

The arrangements of FIGS. 14 and 15 are antisymmetric as a whole, but the individual hairspring arms 140A, 140B, 150A, 150B cannot be antisymmetric or symmetric due to the asymmetric boundary conditions of each arm 140A, 140B, 150A, 150B. A double-arm layout around the free balance wheel 141, 151 means that the torque contribution from each arm 140A, 140B, 150A, 150B eliminates any net radial force on the balance wheel 141, 151. This greatly minimizes the reaction force needed to hold the balance wheel 141, 151 in place and the associated friction is dramatically reduced. However, as each arm 140A, 140B, 150A, 150B tends to distort in the opposite radial direction when the balance wheel 141, 151 is in motion, there is an increased likelihood that the arms 140A, 140B, 150A, 150B may collide in the coils 140C, 140E, 150C, 150E surrounding the balance wheel 141, 151. The use of a double-coil hairspring 140, 150 for each arm 140A, 140B, 150A, 150B brings the distortion away from the balance wheel 141, 151 to the coils 140C, 140E, 150C, 150E surrounding the fixed points. As only one arm 140A, 140B, 150A, 150B extends from each fixed point held by a stud 142, 143 there is a reduced likelihood for a collision.

It will be appreciated by persons skilled in the art that numerous variations and/or modifications may be made to the invention as shown in the specific embodiments without departing from the scope or spirit of the invention as broadly described. The present embodiments are, therefore, to be considered in all respects illustrative and not restrictive.

We claim:

1. An oscillator system of a mechanical timepiece, comprising:

at least one balance wheel that is free to rotate about an axis; and at least one unitary hairspring formed of a continuous, uninterrupted member and connecting the at least one balance wheel to another balance wheel, the another balance wheel having an axis offset from the axis of the at least one balance wheel, the hairspring including:

a first coil connected to the at least one balance wheel; and a second coil connected to the another balance wheel; and a transition section connecting the first coil to the second coil;

wherein an approximately linear restoring torque for the at least one balance wheel is primarily provided by elastic deformation of the transition section and the coils, in order to generate an oscillatory motion for the at least one balance wheel; and wherein the at least one balance wheel and the another balance wheel are identical balance wheels.

2. The oscillator system according to claim 1, wherein if there are at least two hairsprings, the hairsprings are merged to form a single co-planar hairspring with multiple arms, each arm having two coils.

3. The oscillator system according to claim 1, wherein the transition section contains a point of inflection.

4. The oscillator system according to claim 1, wherein the at least one balance wheel and the another balance wheel are connected to each other by the at least one hairspring to generate a synchronized oscillatory motion for the at least one balance wheel and the another balance wheel that is antisymmetric around an equilibrium position of the hairspring.

5. The oscillator system according to claim 4, further comprising two additional hairsprings each with a single coil, each hairspring being attached to one balance wheel at the hairspring's inner end and to a fixed point via a stud at the hairspring's outer end, wherein the single-coil hairsprings contribute to the restoring torque to each balance wheel.

6. The oscillator system according to claim 4, further comprising a user-operated clamp to secure the transition section of the hairspring, the clamp dividing the oscillator system into two isolated oscillators and forcing the oscillator system to oscillate at a second mode at a higher natural frequency than a first mode.

7. The oscillator system according to claim 1, further comprising at least two additional balance wheels, the at least two additional balance wheels are interconnected by hairsprings forming a loop arrangements such that all the balance wheels oscillate in a synchronized manner.

8. The oscillator system according to claim 1, further comprising at least two additional balance wheels, the at least two additional balance wheels are interconnected by hairsprings forming a series arrangement such that all the balance wheels oscillate in a synchronized manner.

9. The oscillator system according to claim 1, further comprising at least two additional balance wheels, the at least two additional balance wheels are interconnected by hairsprings forming a parallel arrangement such that all the balance wheels oscillate in a synchronized manner.

10. The oscillator system according to claim 1, wherein the hairspring is antisymmetric or symmetric.

11. An oscillator system of a mechanical timepiece, comprising:

a first balance wheel that is free to rotate about a first axis and a second balance wheel that is free to rotate about a second axis offset from the first axis; and a first unitary hairspring formed of a continuous, uninterrupted member and connecting the first balance wheel to the second balance wheel, the first hairspring including:

a first coil connected to the first balance wheel;

a second coil connected to second balance wheel; and a transition section from the first coil to the second coil.

12. The oscillator system according to claim 11, wherein the transition section has a point of inflection.

13. The oscillator system according to claim 11, including a second hairspring connecting the first balance wheel to a first fixed point and a third hairspring connecting the second balance wheel to a second fixed point.

14. The oscillator system according to claim 13, further comprising a user-operated clamp to secure the transition section of the first hairspring, the clamp dividing the oscillator system into two isolated oscillators and forcing the oscillator system to oscillate at a second mode at a higher natural frequency than a first mode.

15. The oscillator system according to claim 11, wherein the first hairspring includes a first arm forming the first coil, a second arm forming the second coil, a third arm connecting the first balance wheel to a first fixed point and a fourth arm connecting the second balance wheel to a second fixed point.

16. The oscillator system according to claim 11, including at least one additional balance wheel connected to the first balance wheel by at least one additional hairspring or by an additional arm of the first hairspring.

* * * * *